United States Patent [19]

Hurley et al.

[11] 4,263,878

[45] Apr. 28, 1981

[54] BOILER

[75] Inventors: James R. Hurley, East Weymouth; Edward F. Searight, Harvard, both of Mass.

[73] Assignee: Thermo Electron Corporation, Waltham, Mass.

[21] Appl. No.: 52,648

[22] Filed: Jun. 27, 1979

Related U.S. Application Data

[63] Continuation-in-part of Ser. No. 901,900, May 1, 1978, abandoned.

[51] Int. Cl.[3] ..... F22B 7/00

[52] U.S. Cl. ..... 122/136 C; 122/149; 122/155 A; 122/367 C

[58] Field of Search ..... 122/136 R, 136 C, 149, 122/155 A, 156, 367 R, 367 C; 110/323

[56] References Cited

U.S. PATENT DOCUMENTS

| | | | |
|---|---|---|---|
| 953,023 | 3/1910 | Doran | 122/136 |
| 1,642,539 | 9/1927 | Choimski | 122/155 |
| 2,123,444 | 7/1938 | Thibaudeau | 122/135 |
| 2,348,901 | 5/1944 | Handley | 110/323 |
| 2,508,277 | 5/1950 | Leslie | 122/136 |
| 2,576,053 | 11/1951 | Toner | 122/136 |
| 2,753,851 | 7/1956 | Lemos, Jr. et al. | 122/136 |
| 2,756,032 | 7/1956 | Dowell | 165/156 |
| 2,800,307 | 7/1957 | Putney | 165/108 |
| 3,034,769 | 5/1962 | Bertin et al. | 165/108 |
| 3,073,385 | 1/1963 | Peters | 165/181 |
| 3,183,970 | 5/1965 | Horley | 165/181 |
| 3,360,040 | 12/1967 | Kritzer | 165/181 |
| 3,413,939 | 12/1968 | Phillips | 122/149 |
| 3,450,199 | 6/1969 | Warrell | 165/159 |
| 3,612,001 | 10/1971 | Gossatter | 122/406 |
| 3,734,064 | 5/1973 | Cancilla et al. | 122/367 |
| 3,734,066 | 5/1973 | Scheyen | 122/367 |
| 3,741,168 | 6/1973 | Gaillon-Keredan | 122/149 |
| 3,804,159 | 4/1974 | Searight et al. | 165/181 |
| 3,903,868 | 9/1975 | Salvo | 122/136 |
| 3,907,028 | 9/1975 | Lawson | 165/156 |
| 3,930,941 | 1/1976 | Meerwald et al. | 165/181 |
| 3,934,555 | 1/1976 | Baumgartner et al. | 122/136 |
| 4,023,558 | 5/1977 | Lazaridas | 122/156 |

FOREIGN PATENT DOCUMENTS 1018843 2/1966 United Kingdom .

*Primary Examiner*—Edward G. Favors

*Attorney, Agent, or Firm*—Herbert E. Messenger; James L. Neal

[57] ABSTRACT

A boiler for heating liquid which combines a source of hot gases directed first along the inner wall of an annular tank in a tortuous path formed by fins disposed upon the inner wall and then along the outer wall of the tank through a jet-impingement heat transfer system.

13 Claims, 8 Drawing Figures

BOILER

CROSS REFERENCE TO RELATED APPLICATION

This is a Continuation-in-Part of Application Ser. No. 901,900, filed May 1, 1978, now abandoned.

BACKGROUND OF THE INVENTION

Conservation of energy has become an objective of increasing concern in recent years and one obvious approach to that goal is to increase the efficiency of utilization of energy. Boilers and other heaters of liquid are so commonly used both in industry and residentially that any improvement in their efficiency would of course result in vast savings of energy.

It has long been recognized that greater efficiency in liquid heating can be had by increasing the area of heat-exchanging surfaces between the source of heat and the liquid to be heated. Various designs of liquid tanks have been proposed and one which has shown promise is an annular tank. Generally, in such designs, hot products of combustion in gaseous form are introduced into the cylinder formed by the interior wall of the annular tank. The hot gases pass over the interior wall which serves as a heat-exchange surface to heat the liquid in the tank. It has even been proposed that the gases then be redirected over the exterior wall of the annular tank, in which case, both walls serve as heat transfer surfaces. In some instances, fins, convoluted surfaces, or other area-increasing devices have been used to attempt to improve efficiency of heat transfer but such devices have been self-defeating to some extent because of their interference with the flow of hot gases, because of fabrication costs, and because of complexity of structure. Hence it is the primary object of the present invention to maximize the benefits and the gains in efficiency of heat transfer which can be realized by combining with annular tanks efficient sources of hot gases and heat transfer enhancers which are relatively simple and inexpensive and which operate to avoid the effects of boundary-layer interference with heat transfer.

SUMMARY OF THE INVENTION

The invention is concerned generally with the heating of liquids but relates more particularly to a highly efficient and compact boiler of simple and relatively inexpensive design. The boiler includes as basic elements a source of hot gases such as a burner, an annular water tank and heat transfer enhancers to maximize the transfer of heat from the hot gases through the inner and outer walls of the annular tank to the water within the tank.

An interior chamber is formed at least in part by the inner wall of the tank and gases from the combustion taking place in the burner are forced along a tortuous path through that chamber by stacked groups of radial fins attached in heat conductive relationship to the inner wall. Normally existing boundary layers along the fins and inner wall are disrupted by the turbulence imparted to the gases by the tortuous path set up by rotationally offsetting adjacent groups of fins.

After passing through the interior chamber the gases are redirected along the outer wall of the annular tank through jet impingement heat transfer devices in which elements having perforated walls form the gases into jets directed against unperforated portions of confronting walls. Again, boundary layers are disrupted, heat transfer is enhanced, and water heating is efficiently achieved.

DESCRIPTION OF A PREFERRED EMBODIMENT

Figure 1:
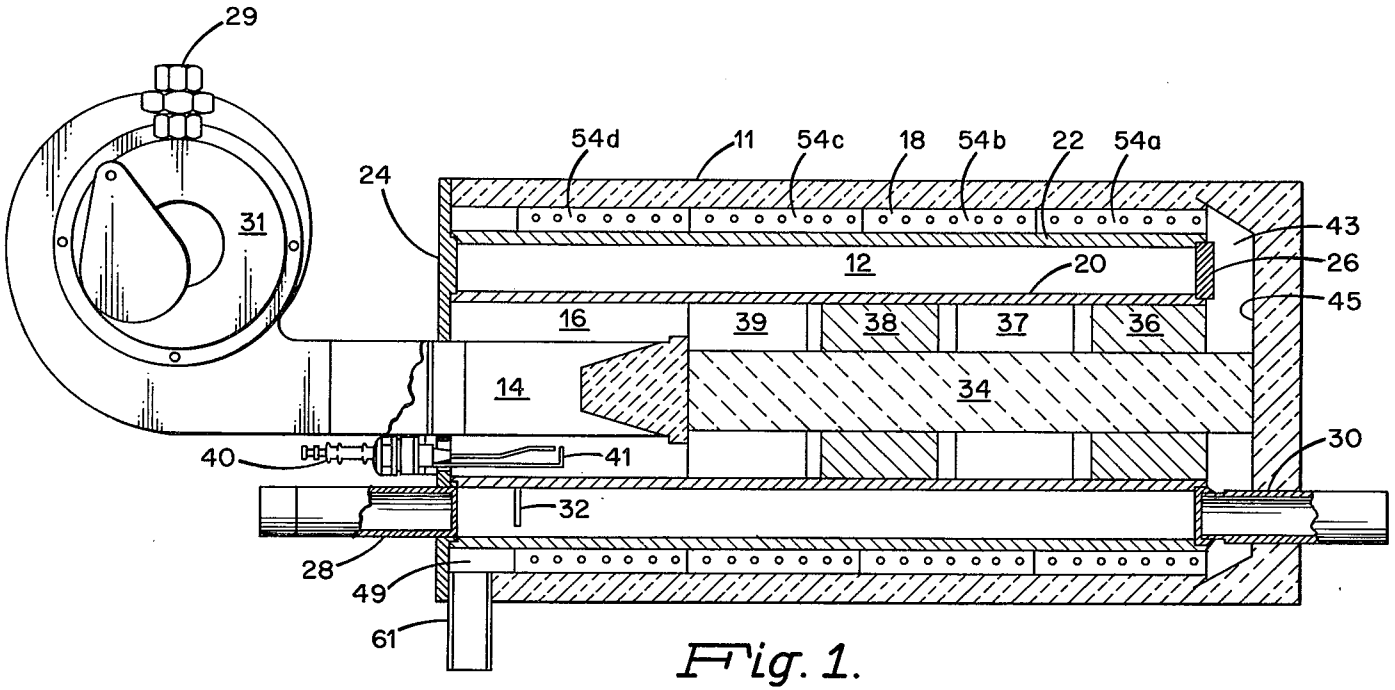
FIG. 1 is a sectional elevation of a liquid heating system embodying the present invention.

In FIG. 1, a preferred liquid heater is shown in the form of a water boiler enclosed in a double-walled insulated jacket 11. Basic working elements include an annular water tank 12, a burner 14 arranged to fire hot gases first through an inner chamber 16 defined in part by the inner wall 20 of the annular tank from which the gases proceed through an exterior chamber 18, defined in part by the outside wall 22 of the annular tank 12. In the exterior chamber there are disposed jet impingement heat transfer enhancing elements described in greater detail below.

The annular water tank 12 is formed into a closed container by concentric inner and outer cylindrical walls 20 and 22, an end plate 24 and an end cap 26. Water to be heated is introduced into the annular tank through an inlet line 28 which is sealed through the end plate 24. Hot water passes from the annular tank through an outlet line 30 sealed in similar fashion through the end cap 26. To prevent the flow of water directly from the inlet line 28 to the outlet line 30, a deflection plate 32 is disposed within the annular tank adjacent to point of entry of the inlet line 28. The deflection plate 32 is curved to conform to and is attached to the inner cylindrical wall 20 and extends radially toward the outer cylindrical wall 22. It has the shape of a section of a disc subtending an angle of about 90° and having its central area disposed roughly opposite the inlet line 28.

The burner 14 may be of conventional design but is preferably a screen, ribbon or other multi-port burner to which fuel such as gas through an inlet 29 and air through a blower 31 may be fed for combustion. The outlet of the blower is sealed centrally through the end plate 24 adjacent a spark ignitor 40 which is also sealed through the end plate 24 and has electrodes 41 disposed adjacent the ports of the burner 14.

The inner chamber which is bounded by the inner wall 20 of the tank may be left with an open center, but it has proven effective to force hot gases toward the wall 20 by inserting at the center a baffle rod or bar of high-temperature insulating material 34.

Upon the inner wall 20 are stacked arrays or groups of fins 36, 37, 38 and 39 which extend radially inwardly from that wall. Each group of fins may be eighteen in number, symmetrically arranged and spaced 20° apart around the periphery of the inner surface of the wall 20. The fins are composed of material of high heat conductivity and may be formed integrally with, or welded or brazed in good heat conducting relationship with the inner wall 20.

Figure 2:
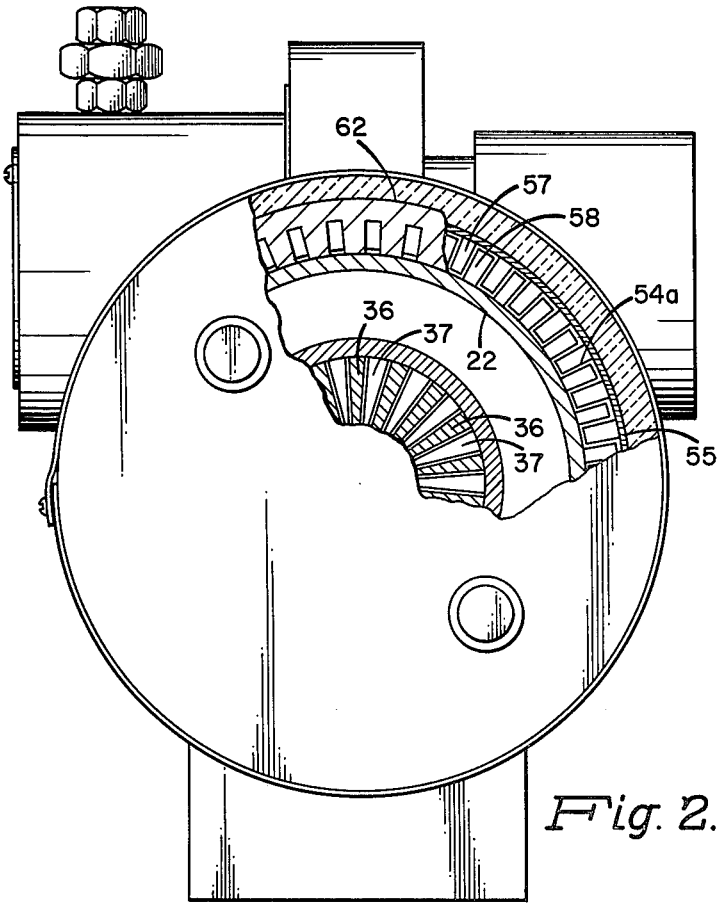
FIG. 2 is an end view of the system of FIG. 1, with portions broken away to show certain internal features of the system.

The disposition of fin groups 36 and 37 is best seen in FIG. 2, and in the system shown in FIGS. 1 and 2 four such groups are employed. The fins of each group are rotationally offset from the adjacent group or groups. In FIG. 2, which illustrates the case of fins having 20° separations, a desirable offset of the fins of group 36 to those of group 37 is approximately 10° as shown. The fins of the succeeding groups 38 and 39 are similarly offset by 10° from adjacent groups.

The slots between the fins are in planes passing through the axis of the inner wall 20 but the staggered arrangement of each group or array relative to its neighboring group imposes a tortuous path upon the flow of hot gases and gives rise to turbulence which disrupts the boundary layers normally encountered in the use of heat transfer surfaces. In other words, the fins are so spaced and arranged that resistance to the flow of gases axially through the chamber 16 is not significantly increased as would be the case with transverse fins extending radially inwardly from the inner wall 20. On the other hand, if there were no rotational offset and the fins of all groups were aligned, the straight passage of gases would not disrupt the boundary layers sufficiently to promote good heat transfer. The low flow resistance resulting from the use of "parallel" fins—i.e., fins with their major heat transfer surfaces parallel to the primary direction of flow of gases through the inner chamber 16—assists in maintaining a low pressure drop through the inner chamber 16.

At the end of the annular tank 12 opposite the burner, hot gases emerge from the inner chamber into a plenum 43 and are diverted outwardly and turned back by a deflector 45 into the external annular chamber 18 formed by the inner wall of the insulating jacket 11 and the outer wall 22 of the tank 12.

Disposed within the external chamber 18 and extending substantially along its full length are a series of jet impingement members. The precise design of these members may be varied but the key design consideration is the formation of jets of hot gases which impinge upon heat transfer surfaces in such a fashion as to disrupt boundary layers, as explained in greater detail below. The heat exchange members in the outer or external chamber 18 may be as simple as a perforated cylinder surrounding the outer wall 22, jets being formed by the apertures of the perforated cylinder and directed against the outer wall to break up boundary layers existing on that wall or they may be in any of several designs which include perforated or slotted fins to assure the impingement of hot gases upon unbroken confronting surfaces of adjacent fins again to break up boundary layers.

Figure 3:
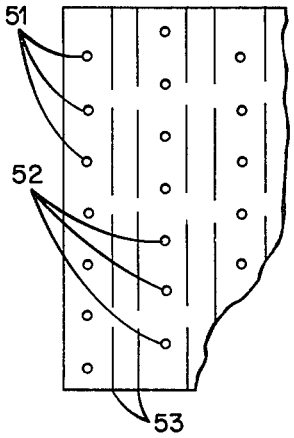
FIGS. 3 and 4 are fragmentary views showing construction methods and details for one of the heat transfer mechanisms useful in the embodiments of FIGS. 1 and 2.
Figure 4:
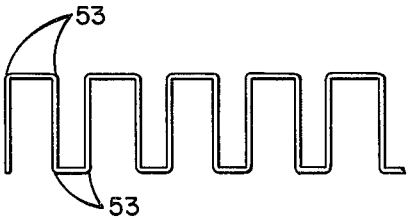

In one preferred structure shown in FIG. 2, walled channels are formed from material which is perforated and folded as illustrated in the fragmentary views of FIGS. 3 and 4. Specifically, in FIG. 3 there is shown a portion of a length of sheet metal in which rows of regularly spaced holes are punched and fold lines are formed. The holes 51 of the first row are symmetrically offset from the holes 52 of the second row and the arrangement is repeated for succeeding rows. The length of material is then folded along the lines 53 and similar fold lines as shown in FIG. 4. The resulting corrugated or convoluted sheet is then wrapped about the outer tank wall 22 to form the rectangular channels mentioned above. The rectangular channels may run substantially the full length of the wall 22 (not shown) or several groups may be formed by sheets stacked one on another. In the embodiment of FIG. 1, for example, four sheets 54*a*, 54*b*, 54*c* and 54*d* are shown stacked in series.

To assure a good heat-conducting relationship between each corrugated sheet such as sheet 54*a* and the outer tank wall 22, the corrugated sheets are fastened or held tightly against the wall 22. One suitable arrangement for this, best illustrated in FIG. 2, includes a sheet metal wrap 55 interposed between the insulated jacket 11 and the corrugated sheet 54*a*.

The desired jet-forming apertures and confronting unperforated heat-transfer surfaces may be constructed in various ways. Applicable theoretical considerations and comparable fabrication techniques are to be found in U.S. Pat. No. 3,804,159, owned by the assignee of the present application and pertinent teaching of that patent is incorporated by reference herein. The important point is that the staggered array of holes must be so arranged that each hole in any given channel wall confronts an unperforated portion of a wall in good heat-conducting relationship with the outer wall 22 in order that gases will be jetted upon the unperforated portion to disrupt boundary layers and increase the efficiency of heat transfer.

Reverting to FIG. 2, and referring to the typical channels 57 and 58, the channel 57 opens into the plenum 43 and the channel 58 is closed. The sequence of open and closed channels is repeated about the periphery of the structure.

Adjacent the plate 24 another plenum 49 is formed. For those embodiments of the invention in which a single corrugated sheet is employed and the rectangular channels run substantially along the full length of the wall 22, the sequence of open and closed channels adjacent to the plenum 49 is reversed from that adjacent to the plenum 43. In other words, typical channel 57 which opens into the plenum 43 is closed off from the plenum 49 and typical channel 58 which is closed off from the plenum 43 opens into the plenum 49. For arrangements such as that shown in FIG. 1, in which two or more sheets are stacked to form a jet impingement structure with multiple stages, each sheet has alternate channels closed off at one end thereof and a reverse sequence of open and closed channels at the opposite end.

In order to close alternate channels at an end of a corrugated sheet as described above, there may be included in the chamber 18 a thin annular tabbed ring such as the ring 62 located at the end of the corrugated member 54*a* adjacent to the plenum 43 (the ring 62 is shown partially broken away in FIG. 2). A similar annular tabbed ring is attached to or held in contact with the end of the corrugated member adjacent to the plenum 49. Also, for jet impingement structures with multiple stages, a tabbed ring is positioned between each jet impingement member to close off the appropriate alternate channels.

Figure 5:
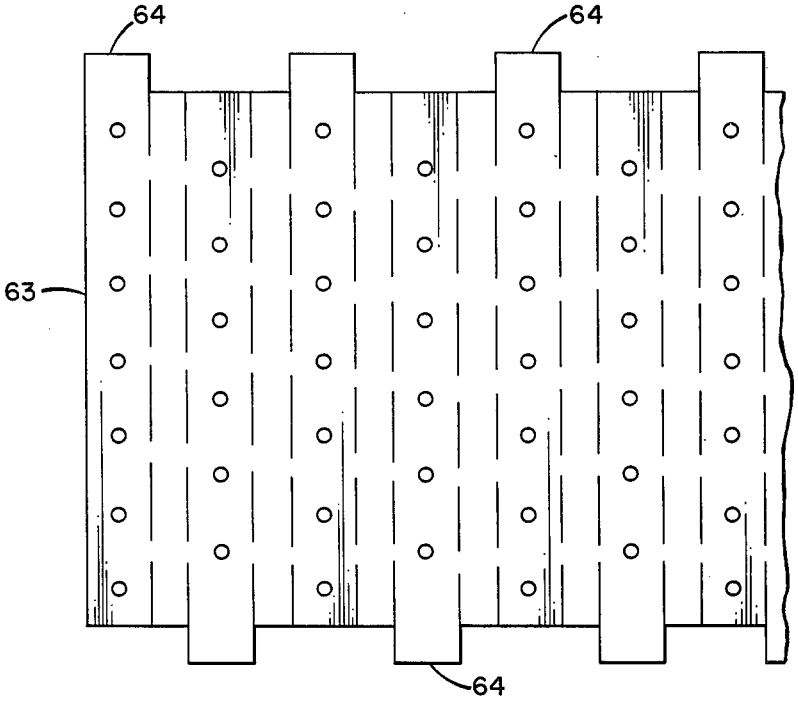
FIGS. 5 and 6 show portions of a sheet having tabs along its sides to assist in forming an alternating sequence of open and closed channels in a jet impingement structure.
Figure 6:
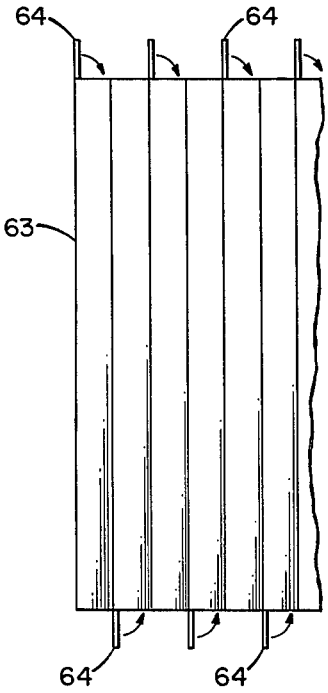

FIGS. 5 and 6 show another arrangement for closing the ends of alternate channels. In this arrangement, a metallic sheet 63 which is to be folded to form a corrugated jet impingement member is provided with a series of tabs 64 along its sides. Either before or after the sheet 63 is folded to form corrugations, the tabs 64 are bent 90 degrees to close alternate channels. FIG. 6 shows a sheet which has been folded to form corrugations and indicates the directions in which the tabs 64 are to be folded to form alternate open and closed channels.

The sheets with integral tabs offer advantages in the fabrication and assembly of a jet impingement structure, particularly when multiple stages are employed. For example, they allow the use of fewer parts than are required for embodiments which employ the tabbed annular rings, and they simplify the wrapping of jet impingement members. Also, they readily permit the separation of multiple stages as will be explained with reference to FIG. 7.

Figure 7:
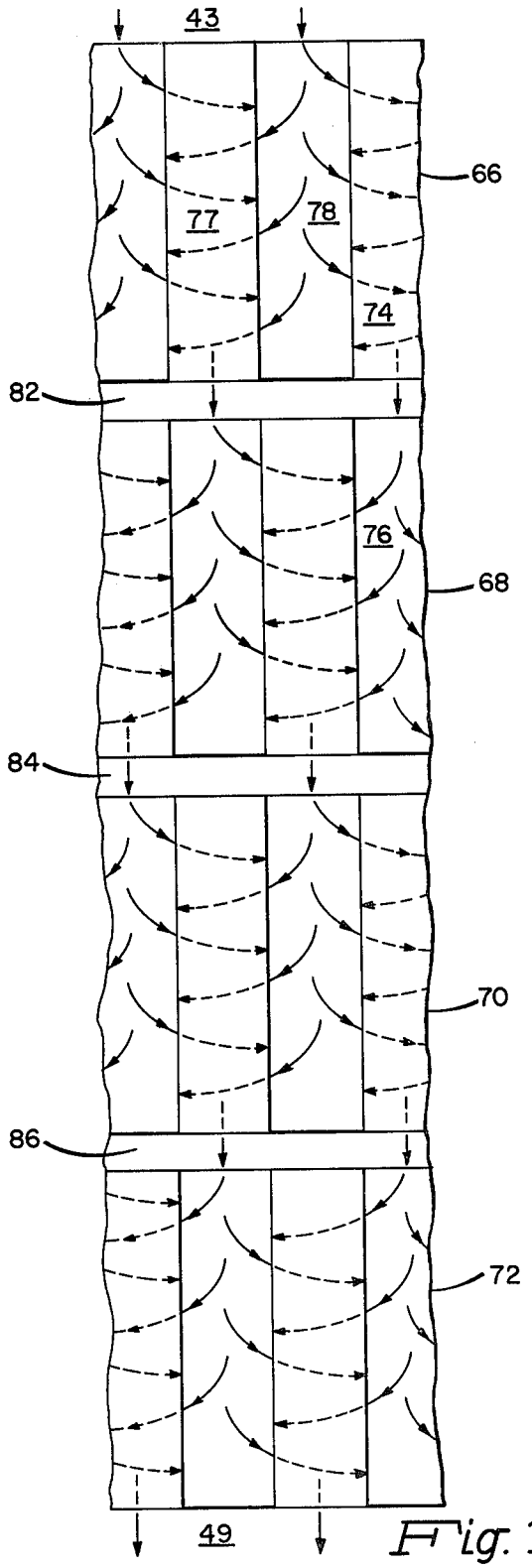
FIG. 7 is a side view in planar form of a jet impingement structure having four corrugated members in series, and illustrating the flow of gas through the structure.

In FIG. 7 there is shown a portion of a preferred jet impingement structure comprising four corrugated sheets or members 66, 68, 70, and 72. The view of these members is a side view of a portion of a boiler similar to that of FIG. 1 as it would appear with the insulated jacket 11 and the metal wrap 55 removed and the jet impingement structure unwrapped into planar form. Solid-line arrows in FIG. 7 indicate the flow of gases which would be visible in this view, while broken-line arrows show the gas flow which would be hidden by peaks or tops of the corrugations of each member.

The corrugated members 66, 68, 70, and 72 are each separated from the adjacent member by a small distance to form plenums 82, 84, and 86. These plenums help in distributing and smoothing flow between stages of the jet impingement structure and in minimizing the detrimental effects which could result from a clogged channel in the structure. The jet impingement members of FIG. 7 are shown as positioned with respect to an adjacent member such that open channel ends are adjacent to open ends—e.g. the flow exit end of a channel 74 of the member 66 is aligned with the open flow inlet end of a channel 76 of the member 68. This causes the jets which have impinged on opposing walls in the channel 74 to then flow in a generally axial direction from the channel 74 through the plenum 82 and into the channel 76. However, the plenums 82, 84, and 86 will readily distribute flow between adjacent jet impingement members no matter how the channels of one member are located with respect to those of an adjacent member—i.e., producing circumferential components of flow in the plenums as required. Thus each member of the jet impingement structure may be positioned independently of all other members, facilitating assembly of the structure. By contrast, if tabbed annular rings such as the ring 63 are used and/or plenums are not provided between jet impingement members, adjacent members must have their channels closely aligned to permit efficient heat transfer and low overall pressure drop through the jet impingement structure.

Now, with reference to FIGS. 1 and 7, during operation of the liquid boiler the hot gases from the burner 14 pass into the plenum 43 from the inner chamber 16, are turned by the deflector 45, and enter open channels such as the channel 78 of the jet impingement member 66. Then, since the opposite end of the channel 78 is closed, all of these hot gases are forced circumferentially through the jet-forming holes in the opposed walls which define the channel 78. The gases emerge into the channels 74 and 77 adjacent to the channel 78 as jets which then impinge upon unperforated portions of the walls opposite the holes. The impinging jets disrupt boundary layers on these walls and aid in the transfer of heat to the walls. Heat is in turn transferred by conduction to the outer wall 22 and to the liquid within the tank 12. After impingement, the gases pass in a generally axial direction parallel to the wall 22 and flow by way of the plenum 82 into the open ends of channels such as the channel 76 in the corrugated sheet 68 next closer to the plenum 49. Jets are again formed by holes in the member 68 and then successively in the members 70 and 72. The gases eventually are discharged from open-ended channels of the member 72 into the plenum 49 and then are carried off by an exhaust line or flue 61 (FIG. 1) which is sealed through the insulating shell 11 and is in fluid communication with the plenum 49.

Figure 8:
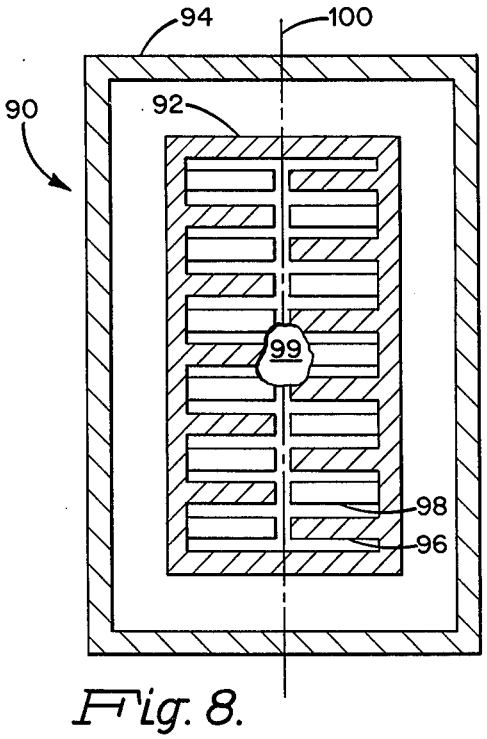
FIG. 8 is a cross-sectional view of an annular water tank according to an embodiment of the invention in which the tank walls are rectangular.

FIG. 8 shows a cross-sectional view of an annular water tank 90 according to an embodiment of the invention for which the inner wall 92 and the outer wall 94 of the tank are rectangular instead of circular in cross-section. The rectangular-walled tank 90 offers two-dimensional flexibility in the modification of tank capacity or in the selection of dimensions so that the tank will fit in a specified location. Also, the rectangular cross-section provides advantages over a circular cross-section in simplifying the integral casting of the fins 96, 98 and the inner wall 92. As indicated in FIG. 8, the fins 96 and 98 of adjacent groups preferably are staggered to induce turbulence in the flow of hot gases through the chamber 99 defined by the inner wall. In contrast to the circular tank 12 shown in FIG. 1, the fins in the rectangular tank shown in FIG. 8 extend nearly to the centerline 100. Thus no baffle rod is provided in the center of the chamber. As in embodiments described above, the outer wall 94 of the rectangular water tank has one or more jet impingement members (not shown) which extend along its length and are held in good heat-conducting relationship with its outer surface.

While there have been shown and described what are considered preferred embodiments of the invention, it should be understood that various other modifications may be made without departing from the scope of the invention. For example, the boiler may readily include a steam chamber and steam outlet in fluid communication with the annular tank, and the boiler may be operable to produce steam as well as hot water. Thus other embodiments are within the following claims.

What is claimed is:

1. A boiler comprising:

an annular tank for holding liquid to be heated, said annular tank having inner and outer walls serving as heat-exchange surfaces, an inner chamber being formed within said inner wall;

an outer shell spaced from and surrounding said outer wall, an outer chamber being formed between said outer shell and said outer wall;

means for directing hot gases first through said inner chamber and then through said outer chamber;

a plurality of heat-exchange enhancing fins disposed in said inner chamber in heat-conductive relationship to said inner wall;

jet-forming means in said outer chamber for forming said hot gases into jets; and heat transfer means in said outer chamber for conducting heat to said outer wall, said heat transfer means having unperforated surface portions confronting said jet-forming means and positioned such that said jets, when formed, impinge on said unperforated surface portions.

2. A boiler as in claim 1 wherein said plurality of fins form a tortuous path along said inner wall for the flow of said hot gases, whereby turbulence is imparted to said gases and boundary layers on said fins are disrupted.

3. A boiler as in claim 1 wherein said jet-forming means and said heat transfer means comprise at least one jet impingement member in heat-conductive relationship with the outer wall of said annular tank, said member having opposed surfaces with jet-forming apertures therein, the apertures in each opposed surface confronting unperforated portions of the surface opposite thereto so that hot gases directed through the apertures form jets which impinge upon said unperforated portions.

4. A boiler as in claim 3 wherein each said jet impingement member comprises a metal sheet formed into a plurality of rectangular corrugations, said corrugations having opposed surfaces extending between, and normal to, said outer shell and said outer wall to define rectangular channels extending along the length of said outer wall, each of said surfaces having a plurality of jet-forming apertures therein arranged to confront unperforated portions of the surface opposite thereto.

5. A boiler as in claim 4 wherein each said jet impingement member includes an inlet end for admitting hot gases and an outlet end for discharging said hot gases, and wherein each said member further includes means for closing each alternate one of said rectangular channels at said inlet end and for closing, in reverse sequence, each alternate one of said rectangular channels at said outlet end.

6. A boiler as in claim 5 comprising a plurality of said jet impingement members arranged in series along the length of said outer wall and wherein each jet impingement member is separated from an adjacent member to form a plenum therebetween.

7. A boiler as in claim 5 wherein said means for closing alternate rectangular channels at the inlet and outlet ends of each said jet impingement member comprise a plurality of tabs formed integrally with each said jet impingement member.

8. A boiler as defined in claim 1 wherein said means for directing hot gases comprises:

a burner disposed to fire hot gases into said inner chamber and a baffle of high-temperature insulating material centrally disposed in said inner chamber to aid in directing said hot gases toward said inner wall.

9. A boiler as defined in claim 1 wherein said plurality of fins disposed in said inner chamber comprise a plurality of stacked arrays of fins extending radially inwardly from said inner wall, each said array being rotationally offset from an adjacent array.

10. A boiler as defined in claim 9 wherein each said array comprises a plurality of fins equiangularly spaced from one another, the angle of spacing between said fins being approximately twice the angle by which each array is offset from an adjacent array.

11. A boiler as in claim 1 wherein said inner and outer walls are rectangular in cross-section and said fins are formed integrally with said inner wall.

12. A boiler comprising:

an annular tank for holding water to be heated, said annular tank having inner and outer walls serving as heat-exchange surfaces, an inner chamber being formed within said inner wall;

an outer shell spaced from and surrounding said outer wall, an outer chamber being formed between said outer shell and said outer wall;

an inlet for introducing water into said tank;

an outlet for removing water from said tank;

said inlet and said outlet sealed through said outer shell;

an end plate at one end of said boiler for closing said inner and outer chambers and said annular tank;

a burner sealed through said end plate and operable to fire hot gases into said inner chamber;

a plurality of arrays of heat-exchange enhancing fins in said inner chamber in heat-conductive relationship to said inner wall, each said array being offset from an adjacent array to form a tortuous path for said gases;

a plurality of jet impingement members in said outer chamber, said members being in heat-conductive relationship with said outer wall and in series arrangement along said outer wall to permit the flow of substantially all of the hot gases from said inner chamber successively through each of said members, each of said members having opposed surfaces with jet-forming apertures therein confronting unperforated portions of the surface opposite thereto;

a deflector disposed within said outer shell at the end of said boiler opposite said end plate for directing hot gases received from inner chamber into the inlet end of the jet impingement member adjacent to said deflector; and a flue sealed through said outer shell for discharging said gases after their passage through each of said jet impingement members.

13. A boiler as in claim 12 wherein each of said plurality of jet impingement members is separated from an adjacent member to form a plenum between said adjacent members, and each member comprises a metal sheet formed into corrugations defining rectangular channels, said metal sheet including tabs for closing the inlet end of each alternate one of said channels and for closing, in reverse sequence, the outlet end of each alternate one of said channels.

* * * * *